United States Patent [19]

Iwai et al.

[11] Patent Number: 4,474,551

[45] Date of Patent: Oct. 2, 1984

[54] COMBUSTION APPARATUS

[75] Inventors: Kazumi Iwai, Mito; Tadashi Shinozaki, Tsuchiura; Yoshio Okamoto, Ibaraki; Hiroshi Inoue, Ibaraki; Yoshifumi Kunugi, Ibaraki; Shigeyuki Yamazaki, Abiko, all of Japan

[73] Assignee: Hitachi, Ltd., Tokyo, Japan

[21] Appl. No.: 381,304

[22] Filed: May 24, 1982

[51] Int. Cl.[3] ..... F23D 15/00

[52] U.S. Cl. ..... 431/351; 431/354; 126/116 R

[58] Field of Search ..... 126/91 R, 91 A, 110 R, 126/110 C, 116 R, 116 B; 431/190, 350, 351, 352, 354

[56] References Cited

U.S. PATENT DOCUMENTS

| | | | |
|---|---|---|---|
| 3,841,301 | 10/1974 | Chamberlain | 126/110 R |
| 4,175,919 | 11/1979 | Matsumoto et al. | 431/351 |
| 4,329,139 | 5/1902 | Shinozaki et al. | 431/350 |

FOREIGN PATENT DOCUMENTS

| | | | |
|---|---|---|---|
| 2127 | 1/1974 | Japan . | |
| 109630 | 8/1979 | Japan | 431/352 |
| 41375 | 3/1980 | Japan . | |
| 54410 | 12/1981 | Japan . | |

*Primary Examiner*—Carroll B. Dority, Jr.
*Attorney, Agent, or Firm*—Antonelli, Terry & Wands

[57] ABSTRACT

A combustion apparatus which includes tertiary air chambers are formed on both sides of a secondary combustion chamber, with tertiary air being supplied to a combustion flame produced within the secondary combustion chamber. The secondary combustion chamber has a flow channel width greater than a width of an opening in a throttle plate provided on the upstream side thereof, thereby achieving universality with respect to enabling use of various fuel and to increase the capacity of the combustion apparatus while reducing the size thereof.

13 Claims, 9 Drawing Figures

COMBUSTION APPARATUS

FIELD OF THE INVENTION

This invention relates to a forced flue-type combustion apparatus, more specifically to a combustion apparatus of such a type that exhaust gas is not discharged inside a room and air necessary for combustion is introduced from outside of the room by means of a fan, with the invention being applicable to various uses such as warm air fans, drying machines or boilers, and particularly suitable for use in a combustion apparatus of capacity control type.

BACKGROUND OF THE INVENTION

A typical combustion apparatus in the prior art is so constructed that a throttle plate is provided within a heat exchanger frame to form a primary combustion chamber together with the heat exchanger frame, a flame aperture surface of a burner is arranged to face the inside the primary combustion chamber at a position opposite to an opening formed in the throttle plate, a premixed gas mixture of fuel gas and primary air is ejected into the primary combustion chamber from the flame aperture surface of the burner, and also secondary air is supplied to the primary combustion chamber from the both sides of the flame aperture surface. There is further formed a secondary combustion chamber on the downstream side of the throttle plate. The prior combustion apparatus with this construction has suffered problems as follows.

A variety of fuels have been used for the forced flue-type combustion apparatus such as, for example, fuel having a less degree of diffusion including gasified liquid fuel such as, kerosene and LPG (Liquid petroleum gas comprising butane and propane), fuel that has low velocity of combustion including natural gas, and fuel that has high velocity of combustion including city gas containing about 60% of hydrogen. These fuels have their own specific characteristics different from each other such that the fuel having a less degree of diffusion is liable to a reddish flame phenomenon, the fuel having low velocity of combustion is liable to a lift phenomenon of combustion flames, and the fuel having high velocity of combustion is liable to a flash-back phenomenon. When attempting to use a variety of gas fuel and gasified liquid fuel such as kerosene in a single combustion apparatus, it is required to reduce a flow rate of primary air to the combustion apparatus so as to lower the velocity of combustion and also to narrow a width of the flame aperture formed in the flame aperture surface of the burner, for the purpose of preventing back fire in the case of burning the fuel with high velocity of combustion. The low flow rate of primary air causes soot to be increasingly generated and a period of time necessary for a burning reaction to be prolonged, so that a relatively large space is required to complete the combustion reaction and a flame is largely elongated in a direction toward the downstream. stream. In general, combustion gas is converted into $CO_2$ gas in the perfect combustion state after having passed through the process of an oxidation reaction of CO on the way. This oxidation of CO requires a sufficiently high ambient temperature under which the gas containing CO is to be reactioned, an oxidizing agent necessary for oxidation, and a reaction space. If not-yet-reactioned gas flows into fins of the heat exchanger frame, the ambient temperature would be reduced to 200°-300° C. and this causes the oxidation reaction of CO to be stopped. Thus, the prior apparatus has been accompanied by such a disadvantage that an increased length of the flame makes it necessary to sufficiently enlarge a height of the secondary combustion chamber, and to allow combustion gas to perfectly react with air and thereafter to flow into the fins of the heat exchanger, thereby resulting in an increase in a height of the secondary combustion chamber. Furthermore, since a width of the flame is fairly narrower than that of a flow channel in the secondary combustion chamber, there occurs a large ineffective area on the both side of the flame within the secondary combustion chamber so that the combustion apparatus includes a dead space therein. It is also required to supply a large amount of secondary air from the under side of the throttle plate, so that a flow rate of the air passing through the opening in the throttle plate becomes large. This causes the flame to be unstable and a pressure loss of the premixed gas mixture ejected from the burner to be increased, thus resulting in such a disadvantage that a fan for use in supplying the premixed gas mixture requires an increased amount of power consumption. When passing through the opening in the throttle plate, the secondary air diffuses into a reaction portion of combustion gas at a low degree and hence most of the secondary air not diffused remains in the aforesaid ineffective area. This also entails a disadvantage that such secondary air will be discharged out to the exterior without effectively contributing to the reaction of CO contained in combustion gas.

SUMMARY OF THE INVENTION

It is an object of this invention to provide a combustion apparatus of universal type which can employ a variety of fuels such as gas, kerosene or the like and which has the increased capacity and reduced size.

To achieve the foregoing object, the combustion apparatus according to this invention is so constructed that a premixed gas mixture is ejected from a flame aperture of a burner into a primary combustion chamber defined by a throttle plate and a heat exchanger frame, secondary air is also supplied to the primary combustion chamber from both sides of a flame aperture surface. A secondary combustion chamber is formed on the downstream side of an opening in the throttle plate, and tertiary air chambers are formed on both sides of the secondary combustion chamber. Each tertiary air chamber is provided with air injection ports to supply tertiary air to a flame produced within the secondary combustion chamber. The secondary combustion chamber is made to have a channel width greater than that of the opening in the throttle plate provided on the upstream thereof, and a tertiary combustion chamber is formed on the down stream side of the secondary combustion chamber.

The aforesaid and other characteristics, objects and advantages of this invention will be apparent upon reading the following description with reference to the accompanying drawings which show, for the purpose of illustration only, several embodiments of a combustion apparatus in accordance with the present invention.

DETAILED DESCRIPTION OF THE INVENTION

Figure 2:
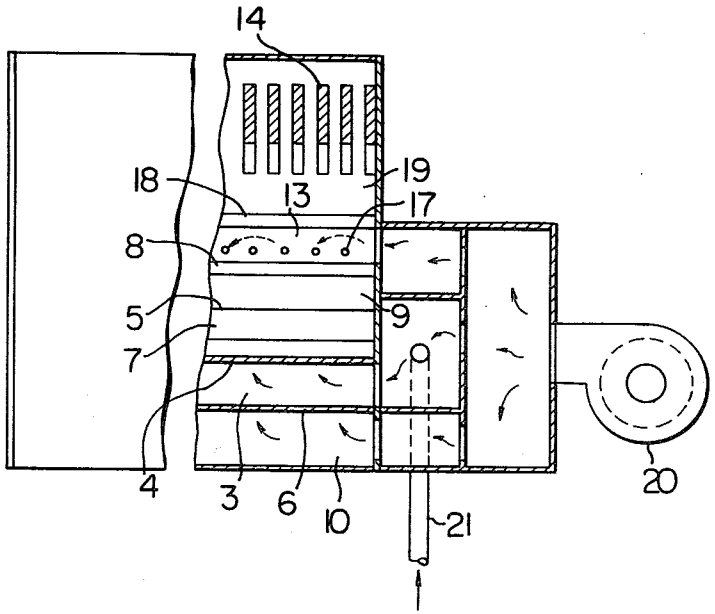
FIG. 2 is a partial cross sectional side view of the combustion apparatus of FIG. 1.

As noted above one object to be achieved by a combustion apparatus of this invention is to provide a form of universality which permits the use of various fuel mixtures including a variety of gas, kerosene or the like. In general, city gas is divided into two categories; natural gas (usually called as 13A gas) and mixed gas of oil gas and hydrogen (gas other than 13A, usually called as 6B, 6C). City gas containing about 60% of hydrogen has higher velocity of combustion than that consisting of natural gas, so that such city gas is liable to back fire. Velocity of combustion is depending on concentration of a premixed gas mixture and increased as the concentration approaches to a theoretical mixing ratio. From this view point, it is required for the concentration to be possibly shifted from the theoretical mixing ratio in order to prevent occurrence of back fire. Meanwhile, city gas containing a large amount of propane as an ingredient thereof, for example 6B gas or 13A gas, is liable to generate soot while burning, because such gas contains a large amount of carbon as an ingredient thereof and hence diffuses at least to some degree into air. This generation of amount of soot is also dependent on an amount of air contained in the gas mixture and reduced as the amount of air is increased. The foregoing two facts indicate that air has opposite dependence with respect to generation of back fire and soot. More specifically, when the rate of primary air (ratio of an amount of primary air to a theoretical amount of air) is reduced, an amount of air contained in the premixed gas mixture becomes less so that back fire can be prevented even when using fuel with high velocity of combustion, but, on the contrary, soot is liable to be increasingly generated. Therefore, a throttle plate has been provided with a view toward restricting the generation of soot by supplying a shortage of primary air with secondary air. With this provision of the throttle plate, combustion gas and secondary air are throttled at the same time when passing through an opening formed in the throttle plate, so it becomes possible to improve diffusion of secondary air into combustion gas to some degree. Even so, however, most of secondary air enters into the ineffective area without diffusing into combustion gas and then discharges out to the exterior. Firstly, the combustion apparatus according to this invention has solved the subject as mentioned above.

Another object to be achieved by the combustion apparatus of this invention is to permit an increase of capacity and reduction of size. The combustion apparatus in the prior art had capacity of $1\times10^7$ Kcal/m$^3$.h at the maximum estimate of a load of the combustion chamber. Meanwhile, this invention has achieved a reduction in size of the combustion apparatus and hence realized a remarkable reduction of the manufacture cost, by making burning capacity of more than $2.5\times10^7$ Kcal/m$^3$.h possible. Stated differently, larger capacity can be obtained with use of the combustion apparatus having the same size as the prior one and this makes it possible to provide a combustor of capacity control type which is able to adjust an amount of combustion changing in the order of above 10 times. Thus, the combustion apparatus of this invention can provide a significant effect also when employed as a combustor of capacity control type. For example, calorific power of 25,000 Kcal/h–3000 Kcal/h is preferable in the case of supplying a usual domestic bath with hot water, whereas calorific power of 2000 Kcal/h–3000 Kcal/h is enough in the case of heating one room. In this manner, when a single combustion apparatus is employed for example, for domestic applications such as for supplying the bath with hot water and heating the room, a ratio of the minimum load to the maximum load becomes to about 1:10. If the prior combustion apparatus were used to adjust an amount of combustion changing in the order of 10 times, a fairly large combustion chamber would be required due to great change of a shape of the flame. In addition, the combustion apparatus designed to give a flame aperture in a flame aperture surface with capacity of 30,000 Kcal/h were subject to burning at 1/10 of that calorific power, namely 3000 Kcal/h, an ejection speed of premixed gas would become very low and hence a stable flame could not be obtained. This invention has also solved this problem at the same time.

In the following, preferred embodiments of the combustion apparatus according to this invention will be described by referring to FIGS. 1 to 8. In the drawings like reference numerals are used throughout the various views to designate identical parts. Referring now to the drawings, a heat exchanger frame 1 has a burner 2 incorporated therein, with a mixing chamber 3 being provided in the burner 2 to introduce a premixed fuel mixture of combustion gas and primary air therein and to rectify the same. A gas mixture rectifying plate 4 is provided within the mixing chamber 3. The burner 2 further includes flame aperture surface generally designated by the reference numeral 5 having a flame aperture 5*a* at the center thereof, and a port portion 6. The flame aperture surface 5 and port portion 6 are disposed on the burner 2 in alignment with a longitudinal direction of the heat exchanger frame 1. A flame retarding means in the form of, for example, a corrugated plate 7 is provided in a passage of the aforesaid port portion 6, with the flame retarding plate 7 serves to stop a burning reaction at its position and hence to prevent further propagation of a combustion flame toward the upstream side of the combustion apparatus. A throttle plate 8 is provided within the heat exchanger frame 1 and has an opening 8*a* at the center thereof. A primary combustion chamber 9 is defined by the throttle plate 8 and the heat exchanger frame 1. The flame aperture surface 5 of the burner 2 faces the inside of the primary combustion chamber 9 at a position opposite to the opening 8*a* in the throttle plate 8, so that the premixed gas mixture of combustion gas and primary air is ejected into the primary combustion chamber 9 from the flame aperture 5*a* in the flame aperture surface 5. A secondary air chamber 10 is adapted to introduce secondary air by means of a fan 20 (FIG. 2) which is provided on the exterior of the combustion apparatus, with a supporting plate 11 being adapted to support the burner 2 in a vertical direction. The supporting plate 11 is formed with a plurality of holes 11*a*, through which secondary air within the secondary air chamber 10 is rectified and then sent into the primary combustion chamber 9. A rectifying plate 12 is provided on both sides of the port portion 6, with the rectifying plate 12 serving to support the port portion 6 with respect to the heat exchanger frame 1 and to further rectify the secondary air having been rectified through the supporting plate 11 and, then to supply the same into the primary combustion chamber 9 from the both sides of the flame aperture surface 5. A secondary combustion chamber 13 is formed on the downstream side of the opening 8*a* in the throttle plate 8. Tertiary air chambers 16 are formed on both sides of the secondary combustion chamber 13 inwardly extending near a flame 15 which is produced within the secondary combustion chamber 13, so that a flow channel of the secondary combustion chamber 13 is defined by the tertiary air chambers 16. The tertiary air chambers 16 are formed with a plurality of air ejection ports 17 with an equal distance therebetween in a longitudinal direction thereof, with the ports 17 serving to supply tertiary air to the flame 15 within the secondary combustion chamber 13. As shown most clearly in FIG. 2, tertiary air is forcibly introduced into the tertiary air chambers 16 by means of the fan 20. The tertiary air is allowed to have uniform distribution of pressure within the tertiary air chambers 16 and thereafter supplied to the flame 15 produced within the secondary combustion chamber 13 from the aforesaid air ejection ports 17. The air ejection ports 17 are not necessarily required to have the form of a circular hole and they may have the form of a slit. A channel width $C_2$ of the secondary combustion chamber 13, defined by the tertiary air chambers 16, is greater than a channel width $C_1$ of the opening 8*a* in the throttle plate 8. Furthermore, in the embodiment of FIGS. 1, 2, there is provided a throttle plate 18 also on a downstream side of the secondary combustion chamber 13, and an opening 18*a* formed in the throttle plate 18 having a channel width $C_3$ smaller than the channel width $C_2$ of the secondary combustion chamber 13. A tertiary combustion chamber 19 is formed on the downstream side of the throttle plate 18, and fins 14 to perform heat exchange are provided on the downstream side of the tertiary combustion chamber 19 and are integrally formed with the heat exchanger frame 1. The fins 14 are arranged in a large number and extend along a longitudinal direction of the heat exchanger frame 1. The arrows shown in the drawings indicate directions in which the premixed gas mixture, secondary air or tertiary air flows, respectively.

Figure 1:
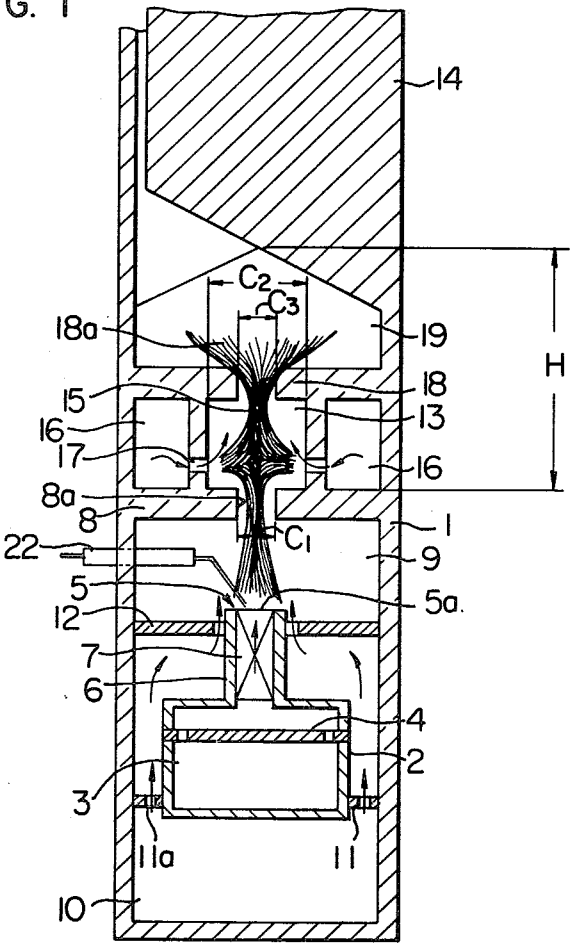
FIG. 1 is a longitudinal cross sectional view of a first embodiment of a combustion apparatus in accordance with the present invention.

The first embodiment of FIGS. 1 and 2 as stated above is constructed with a particular view to sufficiently diffuse tertiary air over the reaction surface. As later described, when enough secondary air is supplied into the primary combustion chamber 9, the channel width $C_3$ of the opening in the throttle plate 18 and the channel width $C_2$ of the secondary combustion chamber 13 may have the relationship of $C_3 \geqq C_2$.

Operation of the embodiment of FIGS. 1 and 2 will be now described. The premixed gas mixture of combustion gas led from a fuel pipe 21 and primary air led from the fan 20 is forcibly supplied into the mixing chamber 3 from one end of the burner 2. Thus, introduced gas mixture is rectified in a longitudinal direction by passing through the holes formed in the gas mixture rectifying plate 4 while restoring pressure thereof in the mixing chamber 3, and then sent to the flame retarding plate 7 on the downstream side. The gas mixture is further rectified through the retarding plate 7 in a longitudinal direction, reaches the flame aperture surface 5 and thereafter is ejected into the primary combustion chamber 9 from the flame aperture surface 5. Thus, ejected gas mixture is ignited by an ignition heater 22, to thereby produce the flame 15 on the flame aperture surface 5 uniformly along a longitudinal direction thereof. Secondary air is uniformly introduced into the primary combustion chamber 9 from the both sides of the flame aperture surface 5 so as to surround the flame 15, and then flows toward the downstream side while reacting with gas not yet burned. The throttle plate 8 provided on the downstream of the flame aperture surface 5 serves to reduce the size of currents of reaction gas (combustion gas) having completely reacted with air within the primary combustion chamber 9, not-yet-burned gas having not completely reacted with air and secondary air at the same time, thereby to sufficiently diffuse the secondary air into the flame 15 and hence promote the burning reaction. Thereafter, these gas and secondary air flow into the secondary combustion chamber 13. Tertiary air supplied from the fan 20 into the tertiary air chambers 16 is forcibly ejected from the air ejection ports 17 toward the flame 15 produced within the secondary combustion chamber 13, so that not-yet-reacted components contained in the flame 15 react with the ejected tertiary air to produce the flame as shown in FIG. 1. The combustion apparatus of this invention is constructed so as to supply tertiary air and supply the burning reaction surface enough with oxidizing agents, whereby there proceeds rapidly the burning reaction within the secondary combustion chamber 13. This makes it possible to reduce a length of the flame 15 remarkably. In addition, since the flame 15 is made to have a shape spreading sidewardly, combustion gas at a high temperature spreads uniformly within the secondary combustion chamber 13 and hence the supplied air is effectively diffused into the flame 15. Combustion gas, not-yet-burned gas and air within the secondary combustion chamber 13 are reduced again in their current sizes through the throttle plate 18 provided at an outlet of the secondary combustion chamber 13, thereby to sufficiently diffuse air over the reaction surface. Accordingly, even in the case that a supply amount of secondary air is reduced and a supply amount of tertiary air is increased, the tertiary air can be diffused enough over the reaction surface so that there occurs perfect burning within the tertiary combustion chamber 19 and hence generation of soot may be restricted completely. Combustion gas having been perfectly burned is led to the multiplicity of fins 14 provided on the downstream of the tertiary combustion chamber 19 so as to pass through clearances defined therebetween, and the fins 14 absorb heat of the combustion gas at that time.

As described in the above, according to the combustion apparatus of this invention, the tertiary air chambers 16 defining the flow channel of the secondary combustion chamber are formed at the portion which was the ineffective area in the prior art, and tertiary air is forcibly supplied from the tertiary air chambers 16 toward the flame 15 produced within the secondary combustion chamber 13, so that oxidizing agents are supplied enough over the burning reaction surface and hence the burning reaction proceeds rapidly. As a result, the length of flame 15 can be significantly reduced and this makes it possible to lower an overall height of the entire combustion apparatus and to achieve a reduction in size of the apparatus. Moreover, with the combustion apparatus having the same height as the prior one, it is possible to obtain an amount of combustion more than two times compared with the apparatus in the prior art, thus permitting an increase of capacity. Consequently, application of this invention to a capacity control type combustor leads to such a remarkable effect that an amount of combustion changing in the order of above 10 times can be adjusted easily.

This invention is also able to provide universality permitting use of various fuel, because a variety of gas, lamp oil or can be employed in the present combustion apparatus. More specifically, the combustion apparatus of this invention is constructed such that air necessary for burning combustion gas is effectively supplied in the form of secondary air and tertiary air, whereby an amount of primary air can be fairly reduced. This makes it possible to shift concentration of the premixed gas mixture apart from the theoretical mixing ratio at a sufficient degree, to reduce a width of the flame aperture of the burner 2 and hence to prevent occurrence of back fire even when using fuel with highvelocity of combustion. Meanwhile, such fuel as containing a large amount of carbon as an ingredient thereof and having a less degree of diffusion can be perfectly burned by efficiently supplying secondary air and tertiary air, thus completely restricting the generation of soot.

Second, third and fourth embodiments of this invention will be described by referring to FIGS. 3 to 5 hereinafter.

The first embodiment of FIGS. 1 and 2 has been constructed with a view toward sufficiently diffusing air over the reaction surface by providing the throttle plate 18 on the downstream side of the secondary combustion chamber 13. However, the throttle plate 18 may be dispensed, as described by referring to the following embodiments, when secondary air is amply supplied into the primary combustion chamber 9, or when tertiary air is introduced in a large amount. In other words, the relationship of $C_2$ and $C_3$ shown in FIG. 1 may be modified to meet an equation of $C_2 \leqq C_3$.

Figure 3:
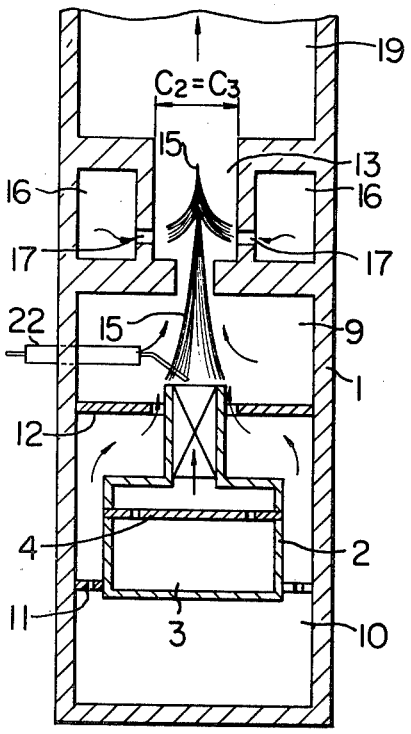
FIG. 3 is a longitudinal cross sectional view of essential components of a second embodiment of a combustion apparatus in accordance with the present invention.

As shown in FIG. 3 the secondary combustion chamber 13 has a channel width $C_2$ which is equal to the channel width $C_3$ of an opening at an outlet of the secondary combustion chamber 13. The embodiment of FIG. 3 is advantageous in that a pressure loss is reduced and the heat exchanger frame 1 is subject to less thermal deformation, because the throttle plate 18 is dispensed with unlike the above first embodiment.

Figure 4:
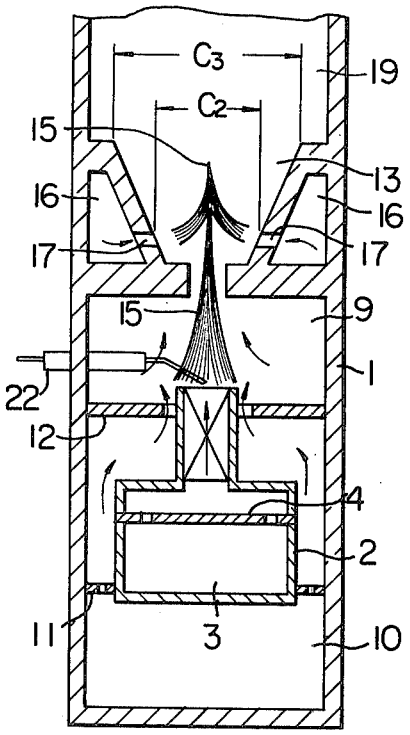
FIG. 4 is a longitudinal cross sectional view of essential components of a third embodiment of a combustion apparatus constructed in accordance with the present invention.

As shown in FIG. 4, the secondary combustion chamber 13 is made to have the channel width $C_3$ of the opening at its outlet greater than the channel width $C_2$ thereof at the position at which the air ejection ports 17 are formed.

Figure 5:
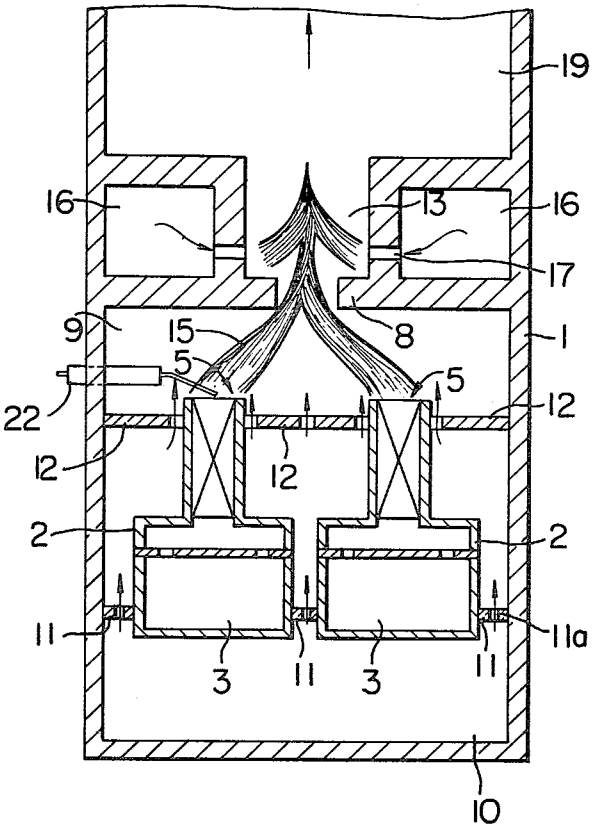
FIG. 5 is a longitudinal cross sectional view showing essential components of a fourth embodiment of a combustion apparatus in accordance with the present invention.

As shown in FIG. 5, two burners 2 are provided and disposed in parallel so as to increase capacity of the combustion apparatus. Secondary air led into the secondary air chamber 10 is rectified by the supporting plate 11 for the supporting the burners 2 while passing through the holes 11*a* formed therein, and then flows between the respective burners 2 and the heat exchanger frame 1 and between the both burners 2. Meanwhile, the flames 15 produced above the flame aperture surfaces 5 of the respective burners 2 are joined together at the throttle plate 8. On this occasion, there exists a layer of secondary air between the both flames 15, so that the flames 15 will be interposed between the layers of secondary air when passing through the throttle plate 8 and hence air is fully diffused into and mixed with not-yet-burned gas. Thus, the embodiment of FIG. 5 allows an amount of secondary air to be increased and an amount of tertiary air to be reduced. Therefore, the secondary combustion chamber 13 has a channel width $C_2$ same as the channel width $C_3$ of the opening at outlet of the secondary combustion chamber 13, similarly to the embodiment illustrated in FIG. 3.

The experimental results on combustion efficiency of the combustion apparatus according to this invention are best illustrated in FIGS. 6 to 9.

Figure 6:
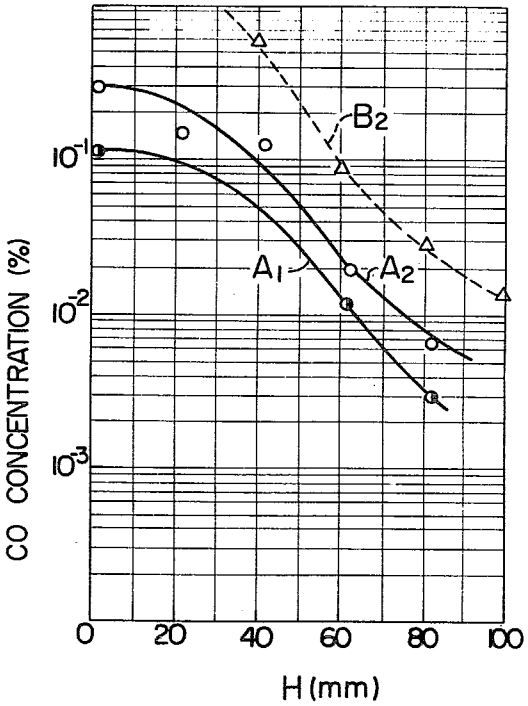
FIG. 6 is a graph illustrating experimental results of combustion efficiencies of a combustion apparatus constructed in accordance with the present invention depicting a comparison of CO concentrations between the combustion apparatus of the present invention and a prior one.

In FIG. 6 abscissa represents a height H of the combustion chambers (secondary and tertiary combustion chambers) formed on the downstream of the throttle plate 8 (refer to FIG. 1), and the ordinate represents CO concentration. Curved lined $A_1$.$A_2$ represent efficiency of the combustion apparatus according to this invention, in which $A_1$ indicates the case of producing calorific power of 10,000 Kcal/h and $A_2$ indicates the case of producing calorific power of 20,000 Kcal/h. A dotted line $B_2$ represents efficiency of the prior combustion apparatus in the case of producing calorific power of 20,000 Kcal/h. It will be apparent from FIG. 6 that CO concentration in the present combustion apparatus is fairly reduced comparing with that of the prior combustion apparatus. For example, assuming now H=80 mm, the prior combustion apparatus showed CO concentration of 0.03%, whereas the present combustion apparatus showed CO concentration of 0.008% which is significantly lower than the prior level. Stated differently, this means that an allowance in capacity of the combustion chamber remains so that it is possible to gain still larger amount of combustion.

Figure 7:
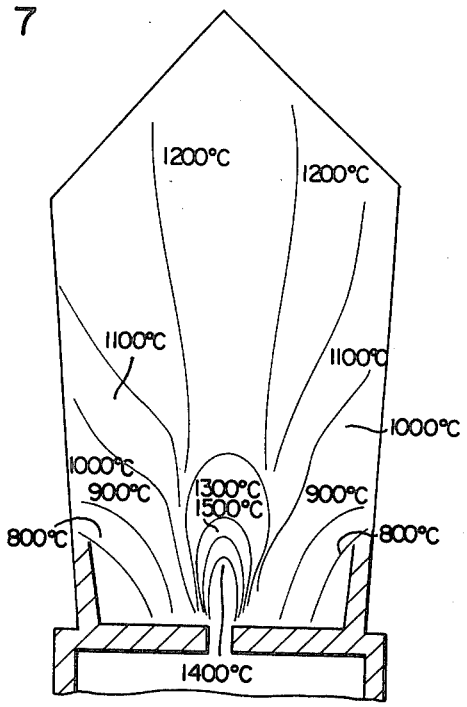
FIG. 7 is a view illustrating a temperature distribution within a combustion chamber when burning in a prior combustion apparatus.

FIG. 7 shows temperature distribution within the combustion chamber of the prior combustion apparatus and, as shown in this figure, combustion gas at a high temperature spreads longer toward the downstream end in the prior apparatus. Thus, the combustion chamber has to be increased in its height in order to effect perfect combustion.

In general, it can be said that an oxidation reaction of CO proceeds fastly when gas containing CO therein is under an ambient temperature of 1400°–1500° C., begins to be stopped gradually at a temperature of 1100° C., and is stopped completely at a temperature of 700° C.

As seen from FIG. 7, combustion gas within the ineffective area is under a relatively low temperature and not subject to the reaction in that area.

Figure 8:
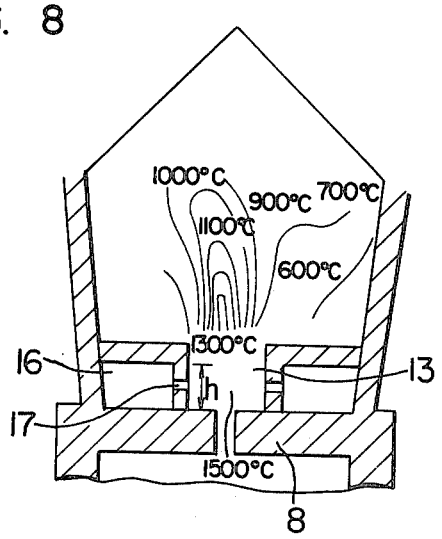
FIG. 8 is a view illustrating a temperature distribution within the combustion chamber when burning in the combustion apparatus of the present invention.

In contradistinction to the temperature distribution of FIG. 7, FIG. 8 shows temperature distribution within the combustion chamber when burning in the combustion apparatus of this invention and, according to the present apparatus, since tertiary air is supplied into the secondary combustion chamber 13 under a high gas temperature, the reaction proceeds rapidly and almost completes its process until reaching the tertiary combustion chamber 19. Therefore, a temperature within the tertiary combustion chamber 19 is lowered and temperature distribution becomes uniform in the whole of the combustion chamber. This means that the entire combustion chamber is effectively utilized in the combustion process. Thus, combustion gas strikes uniformly upon the entire surface of the fins 14 provided in the heat exchanger frame 1 and hence the thermal efficiency of the combustion apparatus is also increased.

Figure 9:
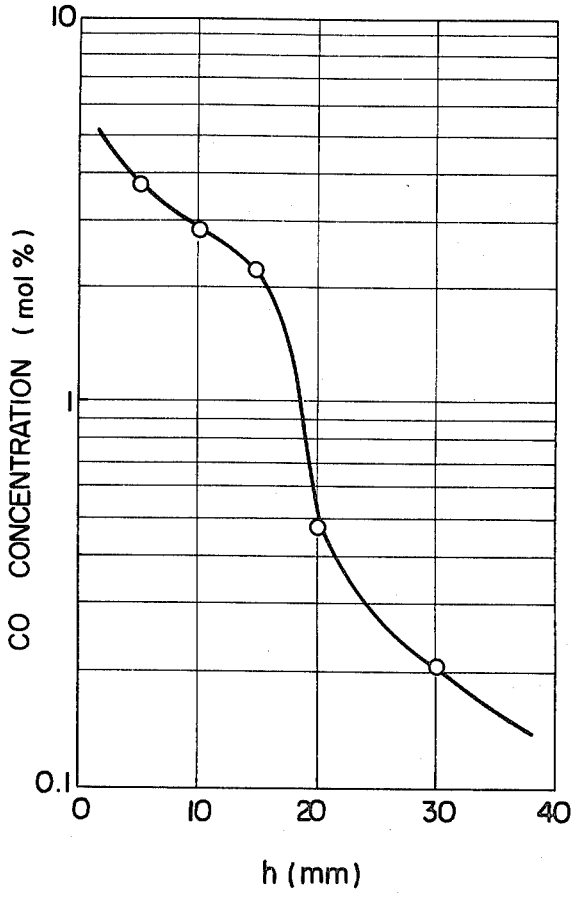
FIG. 9 is a graphical illustration of a distribution of CO concentration within a secondary combustion chamber when burning in the combustion apparatus according to the present invention.

In FIG. 9 the distribution of CO concentration within the secondary combustion chamber 13 when burning in the combustion apparatus of this invention is illustrated, wherein the abscissa represents a height h (refer to FIG. 8) from the throttle plate 8 defining the secondary combustion chamber 13, and the ordinate represents CO concentration relative to the height h. As will be apparent from FIG. 9, CO concentration is gradually reduced along a direction toward the downstream side of the combustion apparatus in such a manner that CO concentration within the secondary combustion chamber 13 at a position of the tertiary air ejection port 17 (h=20 mm) is 0.5 mol %, CO concentration at a position 10 mm from the tertiary air ejection port 17 toward the downstream side (h=30 mm) is 0.2 mol %, and CO concentration at a position 20 mm from the port 17 toward downstream side (h=40 mm) is 0.1 mol %. This CO concentration results from the fact that, according to the present combustion apparatus, tertiary air is forcedly supplied over the reaction surface in the secondary combustion chamber 13 under a high gas temperature in order to supply the burning reaction surface with ample oxidizing agents, whereby the reaction proceeds rapidly and almost completes its process until reaching the tertiary combustion chamber 19.

As fully described hereinabove, the combustion apparatus of this invention is constructed such that the tertiary air chambers 16 are formed on the both sides of the secondary combustion chamber 13 to supply the flame 15 with tertiary air, and the secondary combustion chamber 19 is made to have a channel width greater than that of the opening in the throttle plate 8 provided on the upstream side thereof, thus providing the various following advantages.

1. Since the rate of primary air is lowered and combustion is completed by supplying secondary and tertiary air, a variety of fuels such as, gas, kerosene or the like can be employed as fuel and this realizes universality permitting use of various fuel. It is also possible to make perfect combustion without adjusting an amount of air even when there is a change in fuel used.
2. A load of the combustion chamber can be increased about 2.5 times above previously proposed combustion chambers. This means that there can be obtained about 2.5 times amount of combustion by the combustion apparatus with the same size as the prior one. Thus, it becomes possible to achieve an increase in the capacity of the apparatus while reducing the overall size.
3. The prior combustion apparatus had a limit on its capacity control in a range of about 1/1 to 1/3 with respect to the maximum amount of combustion. According to the present combustion apparatus, however, there can be obtained a stable flame even when an amount of combustion is reduced down to 1/10 of the maximum value, because an increase of capacity can be achieved, an amount of the premixed fuel mixture is able to be reduced due to the reduced amount of primary air, and hence the flame aperture of the burner can be of a small size. Thus, the present combustion apparatus can provide such a very practical effect, when employed as a combustor of capacity control type, that it becomes possible to effect capacity control in a very wide range of about 1/1 to 1/10 with respect to the maximum amount of combustion.
4. The flame is made to have a shape spreading over the entire combustion chamber uniformly, so that there exists no ineffective area within the combustion chamber and the whole of the combustion chamber may be effectively utilized. In addition, this causes temperature distribution at an inlet of the fins provided within the heat exchanger frame to be uniform, whereby thermal efficiency can be improved significantly.
5. Since secondary air used in the prior combustion apparatus is divided into secondary air and tertiary air in the present combustion apparatus, static pressure necessary for driving the fan to supply secondary and tertiary air can be lowered. This makes it possible to reduce power consumption of a motor used for driving the fan and also lower a noise of the fan.

What is claimed is:

1. A combustion apparatus comprising: a heat exchanger frame; a line-shaped burner means including a mixing chamber and a flame aperture surface; a throttle plate provided within said heat exchanger frame and having an opening; and a primary combustion chamber defined by said throttle plate and said heat exchanger frame, characterized in that the flame aperture surface of said burner faces an inside of said primary combustion chamber at a position opposite to said throttle plate, said primary combustion chamber is arranged to be supplied with a premixed fuel mixture ejected from a flame aperture in said flame aperture surface and secondary air introduced from both sides of the flame aperture surface, a secondary combustion chamber is formed on a downstream side of said opening of said throttle plate, tertiary air chambers are formed on both sides of said secondary combustion chamber, said teritary air chambers are formed with air ejection ports adapted to supply tertiary air therethrough toward a combustion flame produced within said secondary combustion chamber, said secondary combustion chamber includes a flow channel having a width greater than a width of the opening in said throttle plate, a tertiary combustion chamber is formed on a downstream side of said secondary combustion chamber and is in communication therewith, said burner means includes a port means for communicating said mixing chamber and said flame aperture surface, a corrugated flame retarding plate means is provided in a passage of said port means, a rectifying plate means is provided on both sides of said port means, the rectifying plate means are adapted to support said port means with respect to said heat exchanger frame, to rectify secondary air, and thereafter supply the rectified air into said primary combustion chamber from both sides of said flame aperture surface, an outlet of said secondary combustion chamber communicating said secondary combustion chamber with said tertiary combustion chamber has a width narrower than a width of said secondary combustion chamber at a position upstream of the outlet to thereby reduce the flow of combustion gas discharged from said secondary combustion chamber into said tertiary combustion chamber.

2. A combustion apparatus comprising: a heat exchanger frame; a line-shaped burner means including a mixing chamber and a flame aperture surface; a throttle plate provided within said heat exchanger frame and having an opening; and a primary combustion chamber defined by said throttle plate and said heat exchanger frame, characterized in that the flame aperture surface of said burner faces an inside of said primary combustion chamber at a position opposite to said throttle plate, said primary combustion chamber is arranged to be supplied with a premixed fuel mixture ejected from a flame aperture in said flame aperture surface and secondary air introduced from both sides of said flame aperture surface, a secondary combustion chamber is formed on a downstream side of said opening of said throttle plate, tertiary air chambers are formed on both sides of said secondary combustion chamber, said tertiary air chambers are formed with air ejection ports adapted to supply tertiary air therethrough toward a combustion flame produced within said secondary combustion chamber, said secondary combustion chamber includes a flow channel having a width greater than a width of the opening in said throttle plate, a tertiary combustion chamber is formed on a downstream side of said secondary combustion chamber and is in communication therewith, said burner means includes a port means for communicating said mixing chamber and said flame aperture, a corrugated flame retarding plate means is provided in a passage of said port means, a rectifying plate means is provided on both sides of said port means, the rectifying plate means are adapted to support said port means with respect to said heat exchanger frame, to rectify secondary air, and thereafter supply the rectified air into said primary combustion chamber from both sides of said flame aperture surface, an outlet opening of said secondary combustion chamber communicating the secondary combustion chamber with the tertiary combustion chamber has a width equal to a width of the flow channel of said secondary combustion chamber.

3. A combustion apparatus according to one of claims 1 or 2, characterized in that heat exchange fin means for effecting a heat exchange are integrally formed on the heat exchanger frame on a downstream side of said secondary combustion chamber.

4. A combustion apparatus according to one of claims 1 or 2, characterized in that said tertiary air chambers extend inwardly near the combustion flame produced in said secondary combustion chamber.

5. A combustion apparatus according to claim 4, characterized in that the flow channel of said secondary combustion chamber is defined by wall portions of said tertiary air chambers.

6. A combustion apparatus comprising: a heat exchanger frame; a line-shaped burner means including a mixing chamber and a flame aperture surface; a throttle plate provided within said heat exchanger frame and having an opening; and a primary combustion chamber defined by said throttle plate and said heat exchanger frame, characterized in that said burner means includes two burner units arranged in parallel, each of said burner units including a flame aperture surface and a mixing chamber, said flame aperture surfaces of said burner units facing an inside of the primary combustion chamber at a position opposite to said throttle plate, said primary combustion chamber is arranged to be supplied with a premixed fuel mixture ejected from a flame aperture in said flame aperture surfaces and a secondary air introduced from both sides of said flame aperture surfaces, a secondary combustion chamber is formed on a downstream side of said opening of said throttle plate, tertiary air chambers are formed on both sides of said secondary combustion chamber, said tertiary air chambers are formed with air injection ports adapted to supply tertiary air therethrough toward a combustion flame produced within said secondary combustion chamber, said secondary combustion chamber includes a flow channel having a width greater than a width of the opening in said throttle plate, and a tertiary combustion chamber is formed on a downstream side of said secondary combustion chamber and is in communication therewith.

7. A combustion apparatus according to claim 6, characterized in that heat exchange fin means for effecting a heat exchange are integrally formed on the heat exchanger frame on a downstream side of said secondary combustion chamber.

8. A combustion apparatus according to claim 6, characterized in that said tertiary air chambers extend inwardly near the combustion flame produced in said secondary combustion chamber.

9. A combustion apparatus according to claim 8, characterized in that the flow channel of said secondary combustion chamber is defined by wall portions of said teritary air chambers.

10. A combustion apparatus according to one of claims 6, 7, 8, or 9 characterized in that each of said burner units includes a port means for communicating the respective mixing chambers and associated flame aperture surfaces, and in that flame retarding means are provided in each of said passage means.

11. A combustion apparatus according to claim 10, characterized in that a rectifying plate means is provided on respective sides of each of said port means, the rectifying plate means are adapted to support said port means of the respective burner units with respect to said heat exchanger frame, to rectify secondary air, and thereafter supply the rectified air into said secondary combustion chamber from both sides of said flame aperture surfaces of said burner units.

12. A combustion apparatus according to claim 11, characterized in that an outlet of said secondary combustion chamber communicating said secondary combustion chamber with said tertiary combustion chamber has a width narrower than a width of said secondary combustion chamber at a position upstream of the outlet to thereby reduce the flow of combustion gas discharged from said secondary combustion chamber into said tertiary combustion chamber.

13. A combustion apparatus according to claim 6, characterized in that the opening in said throttle plate is arranged at a position intermediate to the flame aperture surfaces of said two burner units.

* * * * *